US010333226B2

(12) United States Patent
Hill et al.

(10) Patent No.: US 10,333,226 B2
(45) Date of Patent: Jun. 25, 2019

(54) WAVEGUIDE ANTENNA WITH CAVITY

(71) Applicant: SPEED WIRELESS TECHNOLOGY INC., San Jose, CA (US)

(72) Inventors: Robert Hill, Medford, OR (US); Che Ting Kuo, San Jose, CA (US); Bin Yu, San Jose, CA (US)

(73) Assignee: SPEEDLINK TECHNOLOGY INC., Cupertino, CA (US)

( * ) Notice: Subject to any disclaimer, the term of this patent is extended or adjusted under 35 U.S.C. 154(b) by 108 days.

(21) Appl. No.: 15/455,732

(22) Filed: Mar. 10, 2017

(65) Prior Publication Data

US 2018/0261924 A1 Sep. 13, 2018

(51) Int. Cl.
*H01Q 1/48* (2006.01)
*H01Q 13/06* (2006.01)

(52) U.S. Cl.
CPC ..... *H01Q 13/06* (2013.01); *H01Q 1/48* (2013.01)

(58) Field of Classification Search
CPC ..... H01Q 13/00; H01Q 13/02; H01Q 5/55; H01Q 1/24; H01Q 21/24
USPC ..... 343/772
See application file for complete search history.

(56) References Cited

U.S. PATENT DOCUMENTS 7,446,710 B2 * 11/2008 Wu ..... H01W 21/0075 343/700 MS
8,159,316 B2 * 4/2012 Miyazato ..... G01S 7/032 333/239
2006/0256016 A1 * 11/2006 Wu ..... H01Q 21/0075 343/700 MS
2011/0057853 A1 * 3/2011 Kim ..... H01Q 1/48 343/843
2011/0267152 A1 * 11/2011 Lee ..... H01P 3/121 333/26
2012/0050125 A1 * 3/2012 Leiba ..... H01Q 1/2283 343/834
2012/0206219 A1 * 8/2012 Choi ..... H01P 5/107 333/230
2012/0256796 A1 * 10/2012 Leiba ..... H01Q 1/2283 343/702
2013/0088396 A1 * 4/2013 Han ..... H01Q 9/04 343/700 MS
2014/0240186 A1 * 8/2014 Zhou ..... H01Q 13/06 343/772

* cited by examiner

*Primary Examiner* — Dameon E Levi
*Assistant Examiner* — Jennifer F Hu
(74) *Attorney, Agent, or Firm* — Womble Bond Dickinson (US) LLP

(57) ABSTRACT

According to one embodiment, a waveguide antenna includes a top plane made of electrically conductive material, a bottom plane made of electrically conductive material, a first feed member coupled to the top plane and the bottom plane through a first via, the first feed member to be electrically coupled a transceiver of an electronic device, and an array of vias disposed surrounding the first via. The array of vias coupling the top plane and the bottom plane to form a cavity between the top plane and the bottom plane. When an electrical signal is provided to the first feed member, the first feed member excites a space within the cavity between the top plane and the bottom plane.

18 Claims, 4 Drawing Sheets

WAVEGUIDE ANTENNA WITH CAVITY

FIELD OF THE INVENTION

Embodiments of the present invention relate generally to antennas. More particularly, embodiments of the invention relate to open waveguide antennas with cavity.

BACKGROUND

Mobile devices, such as mobile phones, are becoming increasingly popular. Such devices are often provided with wireless communications capabilities. In wireless communications, waveguide antennas are well-known and have been used in various applications.

Fifth generation (5G) is the next new standard for mobile communications. For the modern mobile device designs, a thinner phone design is a main stream in the industry. Moreover, a 5G system will adopt antenna array configuration for a good signal to noise ratio. However, a narrow beam width cannot cover a wide range link in the environment and therefore the requirement of multi-polarization can be used for scattering problems.

For polarization antennas, the most popular design is the waveguide antenna design. An open wave guide antenna is not appropriate for the design in a thin substrate since the substrate will confine the electric field; furthermore the return loss is bad. A traditional open waveguide antenna needs a wide aperture for power radiation and good return loss. However, the thin board design is not suitable for such waveguide antennas.

BRIEF DESCRIPTION OF THE DRAWINGS

Embodiments of the invention are illustrated by way of example and not limitation in the figures of the accompanying drawings in which like references indicate similar elements.

DETAILED DESCRIPTION

Various embodiments and aspects of the inventions will be described with reference to details discussed below, and the accompanying drawings will illustrate the various embodiments. The following description and drawings are illustrative of the invention and are not to be construed as limiting the invention. Numerous specific details are described to provide a thorough understanding of various embodiments of the present invention. However, in certain instances, well-known or conventional details are not described in order to provide a concise discussion of embodiments of the present inventions.

Reference in the specification to "one embodiment" or "an embodiment" means that a particular feature, structure, or characteristic described in conjunction with the embodiment can be included in at least one embodiment of the invention. The appearances of the phrase "in one embodiment" in various places in the specification do not necessarily all refer to the same embodiment.

According to some embodiments, a waveguide antenna having a cavity for vertical polarization power radiation and a feed point location for good return loss is provided, which can be utilized in a thin package suitable for the 5G design of mobile devices. According one aspect, a waveguide antenna includes a top or first plane made of electrically conductive material (e.g., metal such as copper, silver, platinum), a bottom or second plane made of electrically conductive material, and a first feed member coupled to the top plane and the bottom plane through a first via (also referred to as a through hole). The first feed member can be electrically coupled to a transceiver of an electronic device (e.g., a mobile phone). The waveguide antenna further includes an array of electrical vias disposed surrounding the first via. The array of vias couple the top plane with the bottom plane to form a cavity between the top plane and the bottom plane, leaving an opening of the cavity along or towards the edges of the top plane and the bottom plane. When an electrical signal is provided to the first feed member, the first feed member excites a space within the cavity between the top plane and the bottom plane. Such a structure generates a vertical electrical field between the top plane and the bottom plane.

According to another aspect, the waveguide antenna can be embedded within a radio frequency (RF) frontend package or integrated circuit (IC) or chip. The RF frontend chip may include a wireless transceiver, an amplifier, and/or a down-converter or up-converter for converting an RF frequency to a baseband frequency, or vice versa. The RF frontend chip can be utilized by a variety of mobile devices, such as, for example, 5G mobile phones.

Figure 1:
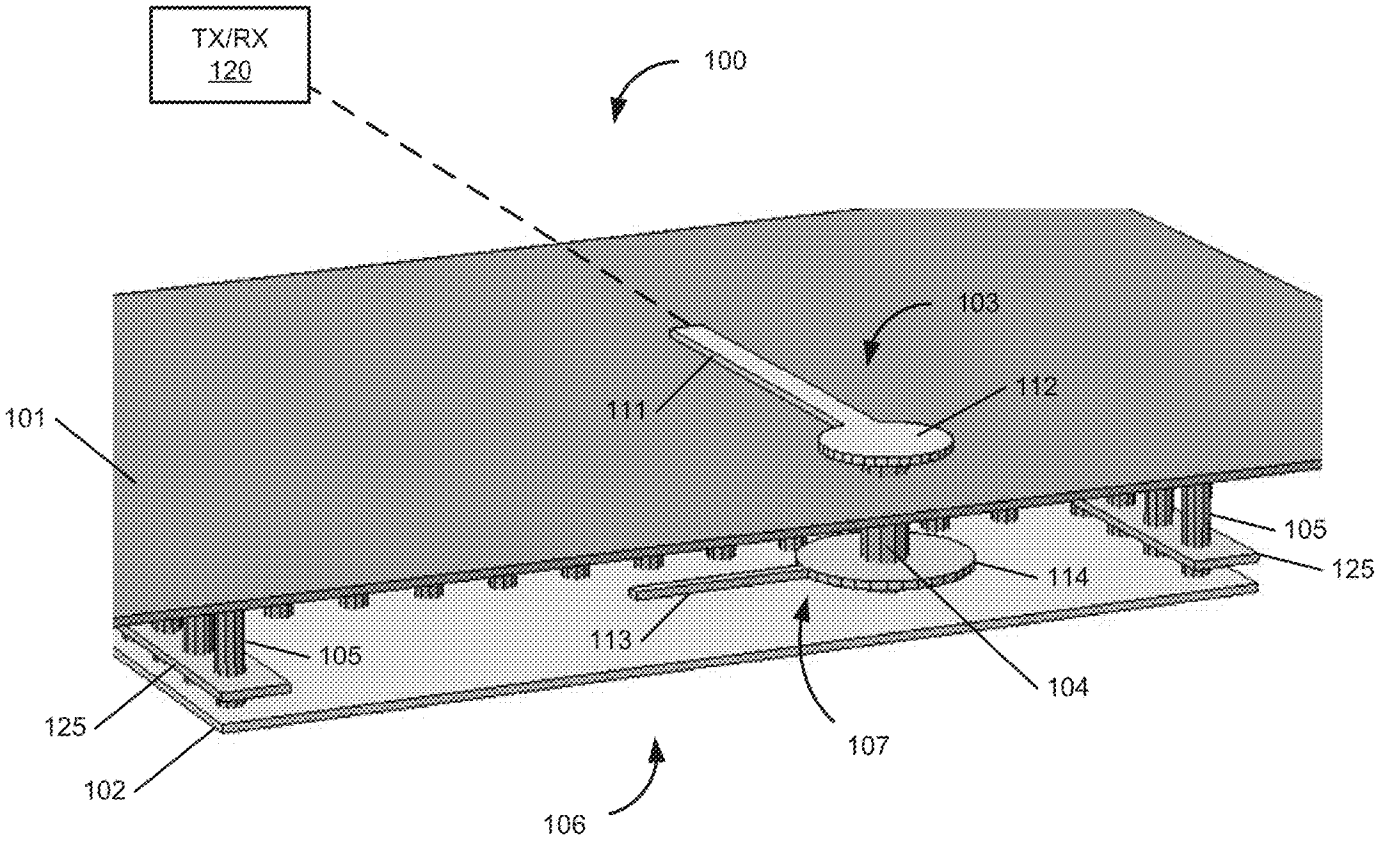
FIG. 1 shows a perspective view of a waveguide antenna according to one embodiment of the invention.

FIG. 1 shows a perspective view of a waveguide antenna according to one embodiment of the invention. Referring to FIG. 1, antenna 100 includes top plane 101, bottom plane 102, and a feed member 103 (e.g., a first feed member) coupled to top plane 101 and bottom plane 102 through first via 104. In this embodiment, the surfaces of top plane 101 and bottom plane 102 are substantially parallel to each other. Similarly, the flat surface of feed member 103 is also substantially in parallel with the surfaces of top plane 101 and bottom plane 102. In addition antenna 100 further includes an array of vias 105 disposed between top plane 101 and bottom plane 102, coupling top plane 101 and bottom plane 102. Vias 105 of the array are arranged in a predetermined pattern, in this example, in a relatively rectangular shape to form cavity 106 between top plane 101 and bottom plane 102.

In electromagnetics and communications engineering, the term waveguide may refer to any linear structure that conveys electromagnetic waves between its endpoints. However, the original and most common meaning is a hollow metal pipe used to carry radio waves. This type of waveguide is used as a transmission line mostly at microwave frequencies, for such purposes as connecting microwave transmitters and receivers to their antennas, in equipment such as microwave ovens, radar sets, satellite communications, and microwave radio links.

Figure 2:
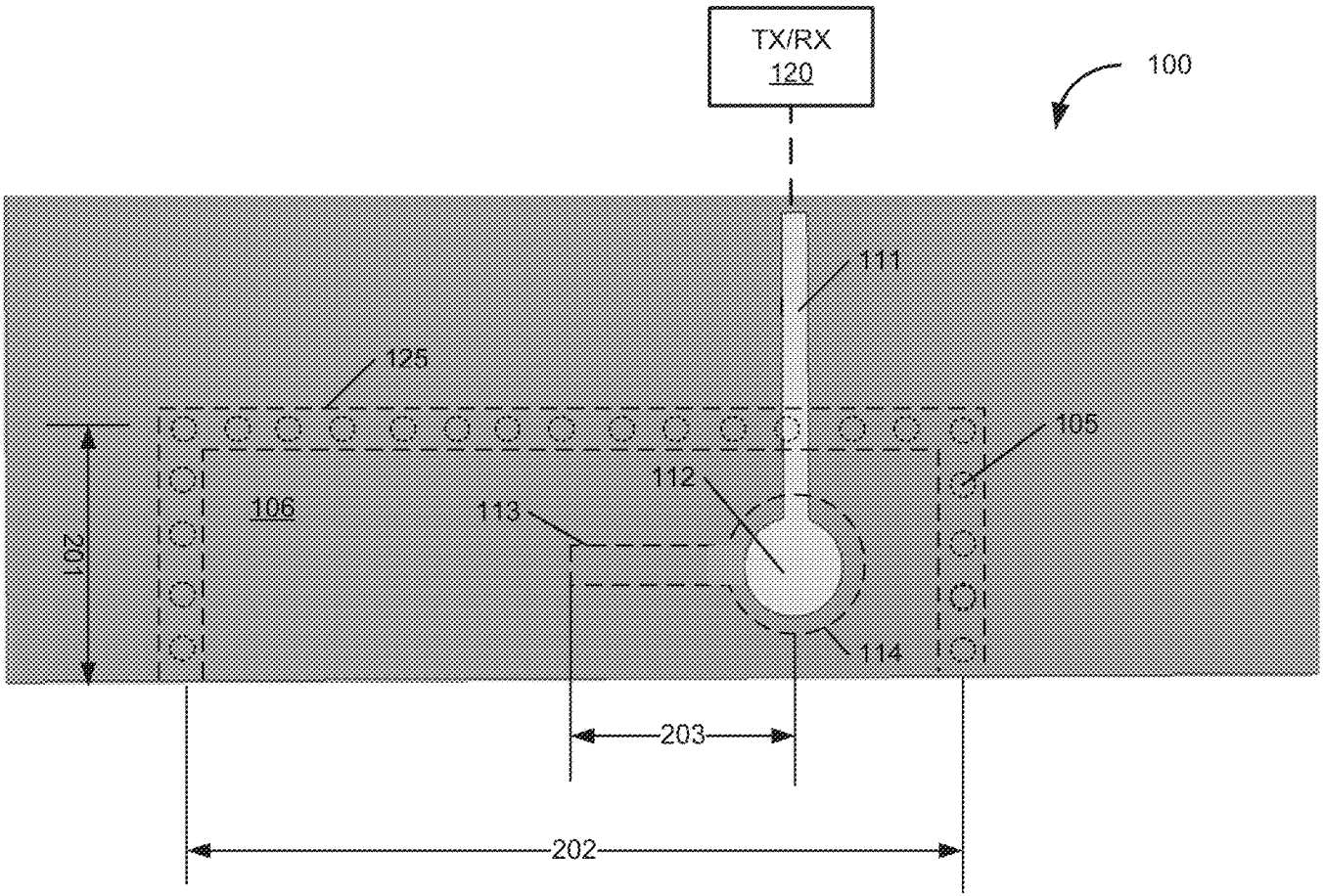
FIG. 2 shows a top view of a waveguide antenna according to one embodiment of the invention.

Referring back to FIG. 1, in this example, the vias of the array 105 are arranged in sequence in a U shape to form an opening of cavity 106 along or towards the edges of top plane 101 and bottom plane 102, while the array of vias 105 operates as part of a wall of cavity 106, as also shown in FIG. 2 as a top view of waveguide antenna 100. Cavity 106 in this example serves as at least a portion of a waveguide for antenna 100. Note that although arrays 105 are arranged in a relatively rectangular shape, they can also be arranged in other shapes, such as, a circular shape, an oval shape, a triangular shape, or a square shape, etc.

In one embodiment, antenna 100 further comprises feed member 107 (e.g., a second feed member) disposed between top plane 101 and bottom plane 102. The flat surface of feed member 107 is substantially in parallel with the surfaces of top plane 101 and bottom plane 102. Feed member 107 is coupled to first via 104, which is in turn coupled to top plane 101, bottom plane 102, and feed member 103. Top plane 101 and bottom plane 102 are coupled to a ground, forming a ground wall. An electrical field is generated vertically between top plane 101 and bottom plane 102 when top plane 101 and bottom plane 102 are excited.

In one embodiment, feed member 103 includes elongate section or portion 111 and circular section or portion 112. Circular section 112 is coupled to a first end of elongate section 111, while a second end of elongate section 111 can be coupled to transceiver 120. In this embodiment, the center or origin of circular section 112 is coupled to first via 104. Feed member 103 is positioned above the top surface of top plane 101, i.e., the opposite side of bottom plane 102 with respect to top plane 101. Feed member 103 is coupled to the top plane 101 and bottom plane 102 only through first via 104, while the rest of feed member 103 is not in contact with top plane 101 or bottom plane 102.

Similarly, feed member 107 includes elongate section or portion 113 and circular section 114. Circular section 114 is coupled to a first end of elongate section 113, while a second end of elongate section 113 is a free end without being coupled to anything. Similar to feed member 103, feed member 107 is coupled to top plane 101 and bottom plane 102 only through first via 104, while the rest of feed member 107 is not in contact with top plane 101 and bottom plane 102. In this embodiment, the center or origin of circular section 114 is coupled to first via 104. With the second feed member, antenna 100 would have a better return loss. The purpose of feed member 107 is to reduce return loss for the desired impedance of the antenna. When feed member 103 receives an electrical signal from transceiver 120, it excites top plane 101 and bottom plane 102, which operate as resonating elements or members, to generate a vertical electrical field between top plane 101 and bottom plane 102.

In one embodiment, antenna 100 further includes elongate strip 125 made of electrically conductive material disposed between top plane 101 and bottom plane 102 along the edges of cavity 106. The surface of elongate strip 125 is substantially in parallel with the surfaces of top plane 101 and bottom plane 102. Elongate strip 125 is formed and arranged along the distribution pattern of the array of vias 105, in this example, in a U-shape as shown in FIG. 2. Elongate strip 125 is electrically coupled to top plane 101 and bottom plane 102 through the array of vias 105. That is, each of vias 105 of the array connects top plane 101 with bottom plane 102 through elongate strip 125. Elongate strip 125 acts as a ground shielding for the antenna.

Figure 3:
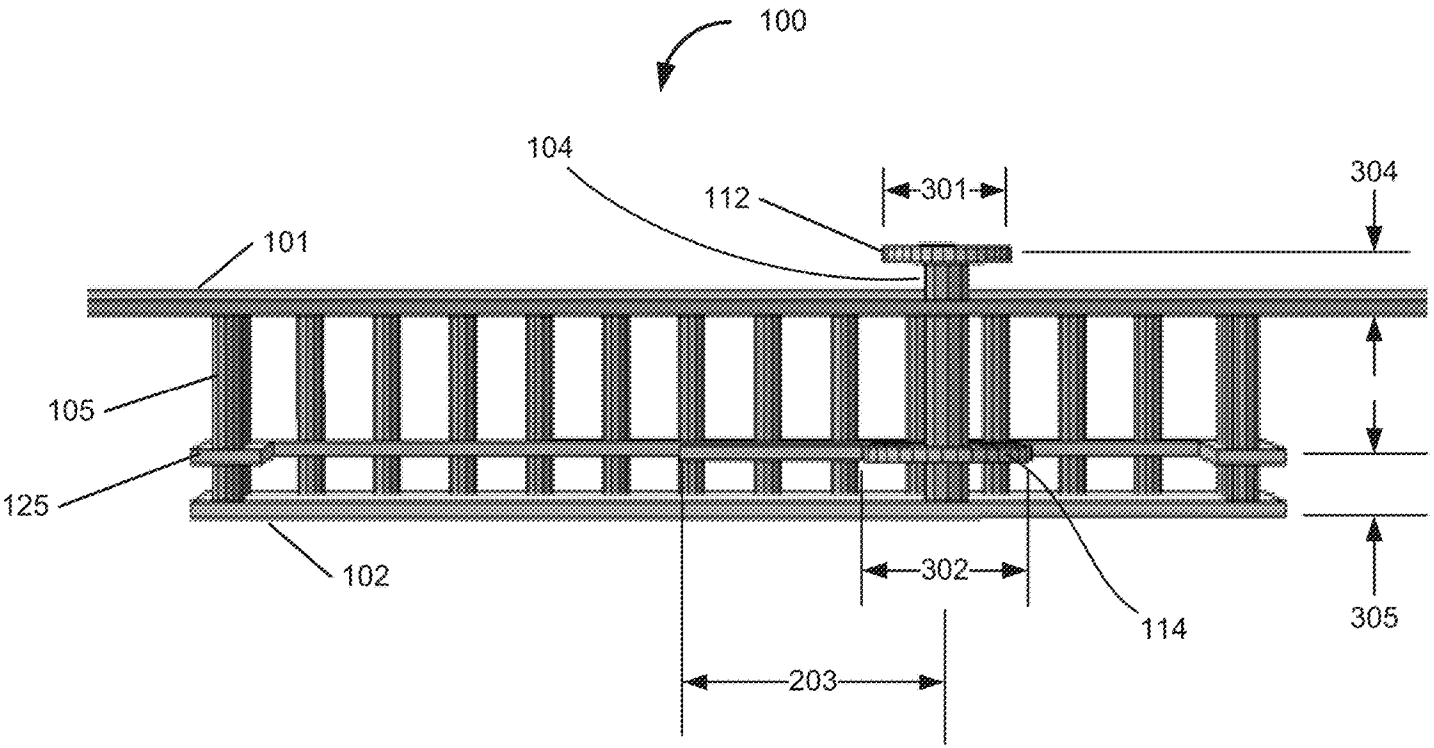
FIG. 3 shows a side view of a waveguide antenna according to one embodiment of the invention.

Referring now to FIGS. 2 and 3, which shows a top view and a side view of antenna 100, cavity 106 is formed in a relatively rectangular shape in this embodiment. In one embodiment, width 201 of cavity 106 is approximately lambda ($\lambda$)/4.5 and length 202 of cavity 106 is approximately $\lambda/2$. The $\lambda$ represents a wavelength associated with an operating frequency of antenna 100. In one embodiment, diameter 301 of circular section 112 is approximately $\lambda/5$. The width of elongate section 113 is approximately $\lambda/4$ and diameter 302 of circular section 114 is approximately $\lambda/4.5$. The average distance between two vias of the array of vias 105 is approximately $\lambda/4$.

Figure 4:
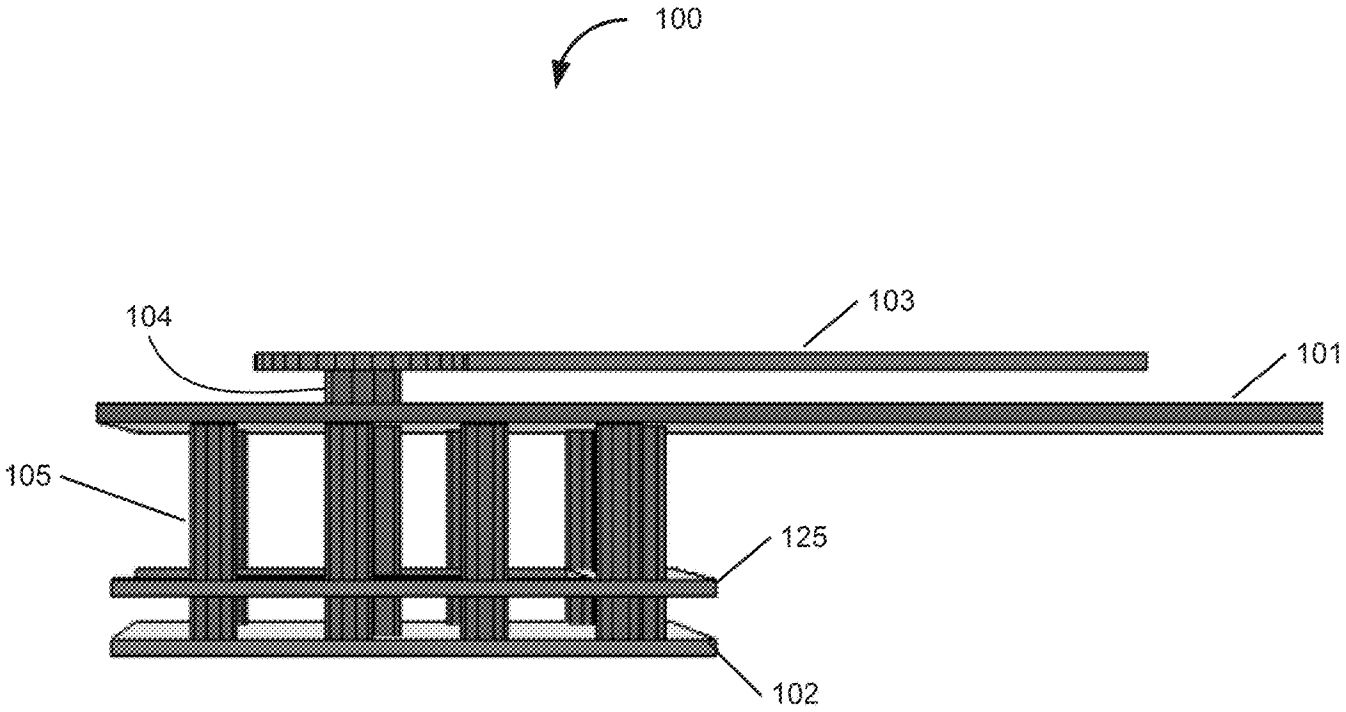
FIG. 4 shows another side view of a waveguide antenna according to one embodiment of the invention.

According to one embodiment, the free end of elongate section 113 is positioned at the center of cavity 106 (e.g., the center point of cavity's length 202). Distance 203 between the free end of elongate section 113 and the center of circular section 114 is approximately $\lambda/4.5$. From the top view, elongate section 111 and elongate section 113 are arranged in a substantially right angle, as the longitudinal axis of elongate section 111 is substantially perpendicular to the longitudinal axis of elongate section 113. Distance 304 between the surfaces of circular section 112 and top plane 101 is approximately $\lambda/10$. Distance 305 between surfaces of elongate strip 125 and bottom plane 102 is approximately $\lambda/10$. FIG. 4 shows another side view of antenna 100.

Embodiments of the present invention are not described with reference to any particular programming language. It will be appreciated that a variety of programming languages may be used to implement the teachings of embodiments of the invention as described herein.

In the foregoing specification, embodiments of the invention have been described with reference to specific exemplary embodiments thereof. It will be evident that various modifications may be made thereto without departing from the broader spirit and scope of the invention as set forth in the following claims. The specification and drawings are, accordingly, to be regarded in an illustrative sense rather than a restrictive sense.

What is claimed is:

1. A waveguide antenna, comprising:

a top plane made of electrically conductive material;

a bottom plane made of electrically conductive material;

a first feed member coupled to the top plane and the bottom plane through a first via, the first feed member to be electrically coupled to a transceiver of an electronic device;

an array of vias disposed surrounding the first via, the array of vias coupling the top plane and the bottom plane to form a cavity between the top plane and the bottom plane, wherein when an electrical signal is provided to the first feed member, the first feed member excites a space within the cavity between the top plane and the bottom plane; and a second feed member coupled to the first via, wherein the second feed member is disposed between the top plane and the bottom plane, and wherein the second feed member comprises a second elongate section and a second circular section coupled to a first end of the second elongate section, wherein a second end of the second elongate section is a free end.

2. The antenna of claim 1, wherein the top plane and the bottom plane are positioned substantially in parallel to each other, forming the space between the top plane and the bottom plane as a part of the cavity partially surrounded by the array of vias.

3. The antenna of claim 1, wherein the array of vias are arranged in a U-shape to form an opening of the cavity towards edges of the top plane and the bottom plane.

4. The antenna of claim 1, where first feed member is positioned above the top plane and coupled to the top plane and the bottom plane via the first via.

5. The antenna of claim 1, wherein the first feed member is only coupled to the top plane and the bottom plane through the first via, while rest of the first feed member is not in contact with the top plane and the bottom plane.

6. The antenna of claim 1, further comprises an elongate strip made of electrically conductive material, wherein the elongate strip is disposed between the top plane and the bottom plane.

7. The antenna of claim 6, wherein the elongate strip is coupled to the top plane and bottom plane through the array of vias.

8. The antenna of claim 6, wherein each of the vias in the array connects the top plane and the bottom plane through the elongate strip, such that the top plane, the bottom plane, and the elongate strip are electrically coupled to each other through the vias.

9. The antenna of claim 1, wherein the first feed member comprises a first elongate section and a first circular section coupled to a first end of the first elongate section, wherein a second end of the first elongate section can be coupled to the transceiver of the electronic device.

10. The antenna of claim 9, wherein the first circular section of the first feed member is coupled to the first via, which couples the first circular section to the top plane and the bottom plane.

11. The antenna of claim 1, wherein the second feed member is substantially in parallel with the top plane and the bottom plane.

12. The antenna of claim 1, wherein the second circular section of the second feed member is coupled to the first via, which couples the second circular section to the top plane, the bottom plane, and the first feed member.

13. The antenna of claim 1, wherein the second feed member is only coupled to the top plane and the bottom plane through the first via, while rest of the second feed member is not in contact with the top plane and the bottom plane.

14. The antenna of claim 1, further comprising an elongate strip made of electrically conductive material, wherein the elongate strip is disposed between the top plane and the bottom plane.

15. The antenna of claim 14, wherein each of the vias in the array connects the top plane and the bottom plane through the elongate strip, such that the top plane, the bottom plane, and the elongate strip are electrically coupled to each other through the vias.

16. The antenna of claim 14, wherein the elongate strip is arranged in a U-shape to surround the second feed member between the top plane and the bottom plane.

17. A radio frequency (RF) frontend integrated circuit (IC), comprising:

a transceiver to transmit and receive electrical signals; and an antenna coupled to the transceiver, wherein the antenna comprises a top plane made of electrically conductive material, a bottom plane made of electrically conductive material, a first feed member coupled to the top plane and the bottom plane through a first via, the first feed member to be electrically coupled to a transceiver of an electronic device, an array of vias disposed surrounding the first via, the array of vias coupling the top plane and the bottom plane to form a cavity between the top plane and the bottom plane, wherein when an electrical signal is provided to the first feed member, the first feed member excites a space within the cavity between the top plane and the bottom plane, and a second feed member coupled to the first via, wherein the second feed member is disposed between the top plane and the bottom plane, and wherein the second feed member comprises a second elongate section and a second circular section coupled to a first end of the second elongate section, wherein a second end of the second elongate section is a free end.

18. The RF frontend IC of claim 17, wherein the top plane and the bottom plane are positioned substantially in parallel to each other, forming the space between the top plane and the bottom plane as a part of the cavity partially surrounded by the array of vias.

* * * * *